United States Patent [19]

Cassidy

[11] 4,109,470

[45] Aug. 29, 1978

[54] METHOD AND MEANS FOR RECLAIMING MECHANICAL ENERGY AND HOT CONDENSATE FROM EXHAUST STEAM

[76] Inventor: James Lawrence Cassidy, 66 Prospect St., Turners Falls, Mass. 01376

[21] Appl. No.: 683,639

[22] Filed: May 5, 1976

[51] Int. Cl.[2] ..... F01K 9/00

[52] U.S. Cl. ..... 60/685; 60/692

[58] Field of Search ..... 60/688, 689, 690, 692, 60/693, 715

[56] References Cited

U.S. PATENT DOCUMENTS 2,132,212 10/1938 Johansson ..... 60/715

FOREIGN PATENT DOCUMENTS 179,126 11/1906 Fed. Rep. of Germany ..... 60/715
500,076 12/1927 Fed. Rep. of Germany ..... 60/715
505,310 5/1939 United Kingdom ..... 60/715

*Primary Examiner*—Allen M. Ostrager
*Attorney, Agent, or Firm*—Ross, Ross & Flavin

[57] ABSTRACT

A method and means for economically producing boiling hot condensate plus mechanical energy from spent steam whereby energy waste and thermal pollution from power stations is greatly lessened. Herein, a combination abentropic engine and hot condenser is interposed between the main turbine exhaust port and a vacuum condenser for the purpose of making the steam do work and thus bringing about condensation at its boiling point. Since the latent energy of spent steam is enthalpic as well as thermic by nature, its extraction as mechanical energy greatly lessens heat release upon condensation.

The mechanical work produced by such an engine depends not upon expansion, as in a main turbine, but upon continuous force exerted by vapor pressure operating on one side of a piston having a vacuum on the other. The pressure is maintained by the operation of Dalton's Law - that vapor pressure depends on temperature alone and not upon volume. The temperature is maintained by the balanced heat release upon condensation.

1 Claim, 2 Drawing Figures

METHOD AND MEANS FOR RECLAIMING MECHANICAL ENERGY AND HOT CONDENSATE FROM EXHAUST STEAM

At first glance, this process sounds impossible, as it is generally held that steam engines will not produce efficiently if the steam is near its condensation point, and that at a low temperature and pressure, exhaust steam is all but useless. The reason for this belief is twofold: first, that steam undergoing condensation in an engine loses volume which negatives expansion, and; second, it is commonly believed that "expansion runs the engine". Strictly speaking, expansion does not run the engine; expansion is merely a parameter of the work done. Force, engendered by steam pressure bearing on a movable area such as a piston face or a turbine blade, moves the piston or blade and does the work or "runs the engine."

Thus, in a main turbine, steam must remain as dry as possible until it has passed the final blade, which is to say that its pressure must be well above that of vacuum, say, 12 or more psi absolute. However, when it enters the cold vacuum condenser, its pressure and temperature drop abruptly to approximately 95° F. and 0.75 psi. or so. A continuing force engendered by this pressure gradient operating on a square foot of piston area is capable of doing considerable work.

So, by interposing a specially designed combination of abentropic engine and hot condenser between the main turbine exhaust port and a cold condenser we can utilize the pressure gradient to make the exhaust steam do work and extract a portion of its energy, thus bringing about condensation at its boiling point.

An abentropic engine is an engine according to the invention for abstracting usable energy from the latent heat of spent steam or vapor which, hitherto, has been considered to be unavailable energy.

In the drawing:

FIG. 1 represents a steam system embodying the invention in its simplest form, practical for very small installations such as paper mills, chemical processing plants and the like, which customarilly exhaust spent heating steam into the atmosphere.

Figure 1:
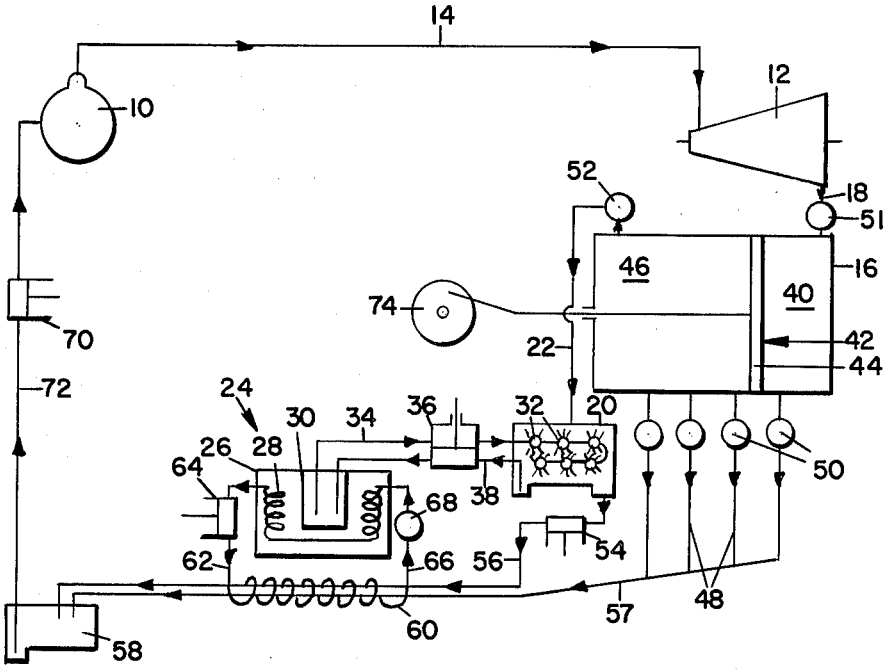
FIG. 1 is a schematic showing of a steam system embodying the invention in its simplest form.

A steam boiler 10 is connected to a main turbine or heating means 12 by a line 14, the main turbine being connected to an abentropic engine and hot condenser 16 by a line 18.

A vacuum or cold condenser 20 is connected to the abentropic engine by a line 22.

A refrigeration means, generally indicated by 24, is provided for cooling vacuum condenser 20. Cooling is done in two stages, the refrigeration means including a brine bath 26 cooled by Freon coils 28, or the like, as the first stage, the bath in turn, as a second stage, maintaining recycled cold condensate in a tank 30 at a temperature of about 40° F. sufficiently above the freezing point to prevent icing of spray nozzles 32 located in vacuum condenser 20.

Condensate passes from tank 30 by a line 34 through a cold condensate circulating means 36 to the spray nozzles and is recirculated from vacuum condenser 20 back through cold condensate circulating means 36 to tank 30 by a return line 38.

Pressurized vapor in a forward chamber 40 of scavenger engine 16 exerts force on the area of piston face 42 of a piston 44 in the engine, causing the piston to move against the vacuum in a rear chamber 46 of the engine, thereby doing work and extracting energy from the vapor in chamber 40, causing some of it to condense at its boiling point. The condensate collects on the walls of the chamber and on the piston face and runs down through drainage ducts 48 and through pressure sensitive valves 50 which prevent regurgitation back into vacuumized chamber 46.

The volume of vapor in chamber 40 constantly shrinks as it condenses, but is constantly replaced by spent steam entering the chamber through inlet line 18 connecting between the chamber and main turbine 12, the inlet line having an inlet valve 51 therein which remains open during most of the stroke of the piston 44.

An outlet valve 52 disposed in line 22 and connected to chamber 46 likewise remains open during most of the stroke of the piston. As the engine is of the double-acting type, the valve sequence reverses as the stroke reverses.

A pump 54 is disposed in a first feedwater line 56 leading from vacuum condenser 20 to a feedwater collection sump 58, the pump serving to draw off cold condensate from the vacuum condenser.

First feedwater line 56 passes through a heat exchanger 60 on the hot end of refrigeration means 24 for returning heat to the system via the feedwater.

A second feedwater line 57 also passes through heat exchanger 60 and connecting between collection sump 58 and drainage ducts 48.

A line 62 connecting between one of the Freon coils 28 of refrigeration means 24 passes through a pump 64 to one end of heat exchanger 60. A line 66 connects between the other end of the heat exchanger and the other Freon coil passes through a valve 68.

A boiler injection pump 70 is disposed in a line 72 connecting between collection sump 58 and boiler 10.

A D.C. electric generator 74 or other means, is connected to piston 44 of scavenger engine 16 for utilizing the work done by the engine by powering auxiliary equipment such as an electrolysis system for the production of hydrogen and oxygen as stored energy.

Also envisioned are a water pump for a pumped storage system connected to the piston of abentropic engine 16.

A means, not shown, is provided to automatically regulate the load on the generator or pump to conform with that of the main turbine, and to provide additional adjustment of load to maintain mechanical energy extraction at optimum levels and maximum efficiency of operation.

In greater detail, as spent steam enters engine 16 and impinges on the face of piston 44 whose face area is, let us say, one square foot, a force of some 1600 pounds results, sufficient to overcome all normal frictional resistance and to do considerable work. As work is done by vapor molecules pressing on the face of the piston, they lose energy and hence temperature, momentarily, causing them to condense at their boiling point and release the remainder of their latent heat content, thereby immediately restoring the temperature but reducing volume in the vicinity of the piston face. Thus, room is made for incoming vapor causing it to flow freely and preventing throttling or back-up in the main turbine. The combination of the kinetic rush of the incoming steam and its sustained vapor pressure, which does not decrease as condensation occurs due to the operation of Dalton's Law, which states that vapor pressure depends on temperature alone and is not affected by volume change, smoothly continues the condensation process. The rate of condensation is thus controlled by both the movement of the piston or work done and the release of heat at constant temperature as condensation occurs; the one causes condensation to occur, the other holds it in check, thereby favoring smooth, steady operation.

Though the latent heat in the spent steam contains virtually as much energy as the electricity generated by the main turbine 12, (modified Clapeyron-Clausius equation), its parameters are reversed; that is, the Pv of the main turbine becomes the pV of the latent heat. In other words, its pressure is reduced while its volume is increased proportionately. Thus, its efficiency in producing mechanical energy is much reduced; however, it is sufficient for the purposes of this process.

Vacuum condensers cooled by refrigeration rather than with coils of tubing circulating copious amounts of cool water are seldom used in present power house practice because of size and cost requirements. However, where size requirements are small, refrigeration has the advantage of returning latent heat to the system and lowering the cold sink temperature. It also has the advantage of adding an additional dimension to power house siting practice, that of allowing power plants to operate without regard to the proximity of copious supplies of cooling water. And, or course, it eliminates thermal pollution.

In the process of this invention, the bulk of the spent steam is condensed at its boiling point in the hot condenser, represented by engine 16, thus relieving vacuum condenser 20 of that burden, permitting the use of a much smaller vacuum condenser than is used in present practice, thereby making the use of refrigeration feasible.

Further, the employment of a spray comprised of chilled droplets of its own condensate recycled and used as a heat exchange medium instead of cooling tubes serves to reduce size and costs still more. Such a chilled spray heat exchanger in the vacuum condenser has the additional advantage of being instantly responsive to regulation so the resultant cold condensate can be brought off at a warmer temperature than in present practice to conserve more heat in the system.

For small installations, a simple cylinder and piston type engine of the type shown in FIG. 1 is used either singly or in multiples arranged in parallel and is equipped with suitable hot condensate drainage systems and means of utilizing the mechanical energy produced.

Figure 2:
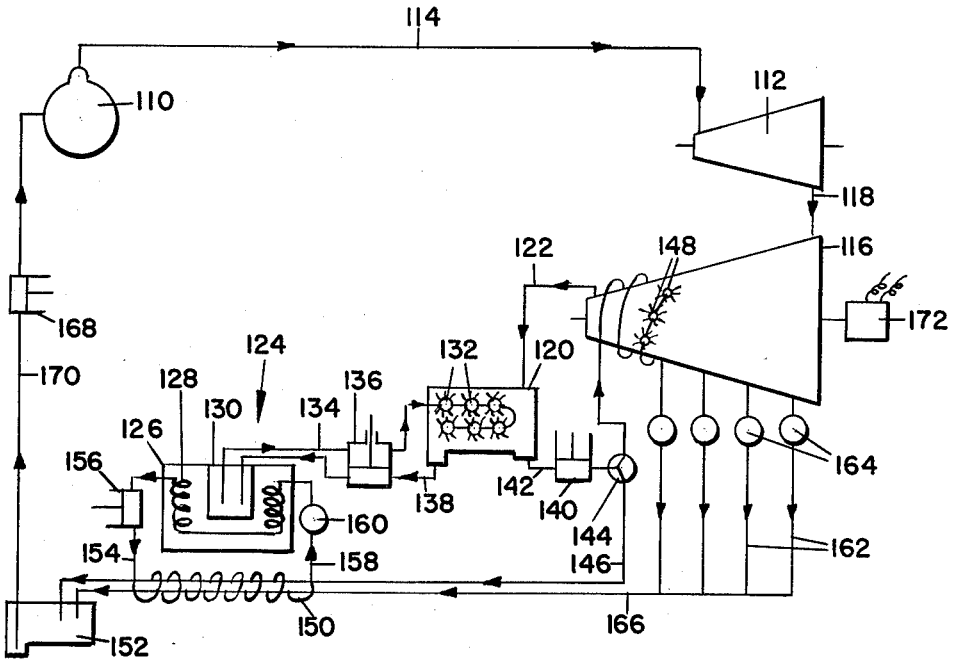
FIG. 2 is a schematic showing of a steam system embodying another form of the invention on a larger scale.

FIG. 2 represents an installation on a larger scale. The principle is the same as in the smaller model of FIG. 1, but a turbine type of abentropic engine and hot condenser is used instead of the simple reciprocating type. For extremely large plants, multiple units can be hooked up in parallel. The condensate flow in such plants can be in the neighborhood of several hundred gallons per minute.

A boiler 110 is connected to a main turbine 112 by a line 114, the main turbine being connected to a turbine-type abentropic engine and hot condenser 116 by a vapor inlet line 118.

A vacuum or cold condenser 120 is connected to the abentropic engine and hot condenser by a vacuum outlet line 122.

A refrigeration means, generally indicated by 124 is provided for cooling vacuum condenser 120. Cooling is done in two stages, the refrigeration means including a brine bath 126 cooled by Freon coils 128, or the like as the first stage, the bath in turn, as a second stage, maintaining recycled cold condensate in a condensate chilling tank 130 at a temperature of about 40° F. sufficiently above the freezing point to prevent icing of spray nozzles 132 located in vacuum condenser 120.

Condensate passes from tank 130 by a line 134 through a cold condensate circulating means 136 to the spray nozzles and is recirculated from vacuum condenser 120 back through cold condensate circulating means 136 to tank 130 by a return line 138.

An auxiliary turbine spray pump 140 is disposed in a line 142 connected at one end to the vacuum condenser 120 and at its opposite end to a proportioning valve 144 disposed in a cold condensate recycling duct or feedwater 146.

An appropriate regulating device, not shown, will be provided for the proportioning valve 144 to distribute the condensate either to the scavenger 116 or to the feedwater line.

Duct 146 connects to spray nozzles 148 within engine 116 and passes through a heat exchanger 150 on the hot end of refrigeration means 124 to a feedwater sump 152.

A line 154 connecting between one of the Freon coils 128 of refrigeration means 124 passes through a pump 156 to one end of heat exchanger 150. A line 158 connects between the other end of the heat exchanger and the other Freon coil and passes through a valve 160.

Hot condensate drainage ducts 162, each having pressure sensitive valves 164 therein, are connected at one end to engine 116 and at their opposite ends to a second feedwater line 166 which passes through heat exchanger 150 to feedwater sump 152.

A boiler injection pump 168 is disposed in a line 170 connecting between collection sump 152 and boiler 110.

An electric generator 172 or other means, is connected to engine 116 for utilizing the work done by the engine.

In the system of FIG. 2 for larger installations the spent steam is caused to enter a suitably insulated turbine type engine 116 whose entry end has essentially the same cross sectional area as the exhaust end of the main turbine, the spent steam progressing through sections whose cross sectional area is compatible with the decreasing volume of the condensing steam to a final section equipped with automatically regulated spray nozzles dispensing condensate from the cold condenser sump or from a tank of chilled condensate regulated to operate at times when excess quantities of vapor escape condensation in the fore part of the abentropic engine and hot condenser as during peak loads on the main turbine. The engine 116 is equipped with rotors and blades of special design suitable for handling copious quantities of hot condensate efficiently at low pressures.

Engine 116 can be incorporated in the main turbine body as a continuation of the exhaust end and mounted on the same shaft.

I claim:

1. A process for salvaging and recycling all the latent heat energy of exhaust steam comprising:

(a) generating steam in a steam generator;

(b) leading said steam to a turbine for expansion for obtaining useful work;

(c) leading the final exhaust steam through an expansible chamber device;

(d) wherein a vacuum is maintained on the non-working side of said expansible chamber device;

(e) such that the exhaust steam is forced to do work by virtue of its higher residual vapor pressure which brings about condensation of a major portion of the exhaust steam at a temperature near its boiling point during the working stroke of the expansible chamber device;

(f) leading said resulting hot condensate from the major portion to a feedwater tank;

(g) removing the minor portion of the exhaust steam which has not condensed, to a condenser cooled by a controlled spray of refrigerated condensate chilled by a refrigerator;

(h) leading the resulting cold condensate through a heat exchanger attached to the hot coil of the refrigerator prior to delivering it to the feedwater tank;

(i) recycling the contents of the feedwater tank back to the steam generator;

(j) repeating the steps of *a* –*i* in a continuous cycle; and (k) recycling the mechanical work done as expedience may require.

* * * * *